US010466024B1

(12) United States Patent
Choiniere et al.

(10) Patent No.: US 10,466,024 B1
(45) Date of Patent: Nov. 5, 2019

(54) PROJECTILE LENS-LESS ELECTRO OPTICAL DETECTOR FOR TIME-TO-GO FOR COMMAND DETONATION

(71) Applicant: BAE SYSTEMS Information and Electronic Systems Integration Inc., Nashua, NH (US)

(72) Inventors: Michael J. Choiniere, Merrimack, NH (US); Bruce Winker, Weaverville, NC (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 3 days.

(21) Appl. No.: 16/123,440

(22) Filed: Sep. 6, 2018

(51) Int. Cl.
*F42C 13/02* (2006.01)

(52) U.S. Cl.
CPC ..... *F42C 13/02* (2013.01); *F42C 13/023* (2013.01)

(58) Field of Classification Search
CPC ..... F42C 13/02; F42C 13/023; F42C 13/026
USPC ..... 102/213
See application file for complete search history.

(56) References Cited

U.S. PATENT DOCUMENTS 4,611,912 A * 9/1986 Falk ..... G01S 17/58 356/28.5
4,733,609 A * 3/1988 Goodwin ..... F42C 13/023 102/213
4,859,054 A * 8/1989 Harrison ..... F42C 13/023 356/5.06
5,669,581 A * 9/1997 Ringer ..... F41G 7/222 244/3.16
5,835,204 A * 11/1998 Urbach ..... G01S 7/4863 356/5.01
6,060,703 A * 5/2000 Andressen ..... F41G 7/008 250/203.6
7,533,849 B2 5/2009 Zemany et al.
7,999,212 B1 8/2011 Thiesen et al.
8,450,668 B2 5/2013 Maynard et al.
8,502,127 B2 * 8/2013 McNeish ..... F42B 15/01 244/3.1
9,683,814 B2 6/2017 Dryer
2005/0030219 A1 * 2/2005 Friedrich ..... F41G 7/226 342/68

* cited by examiner

*Primary Examiner* — Bret Hayes
(74) *Attorney, Agent, or Firm* — Davis & Bujold, PLLC

(57) ABSTRACT

The system and method for accurately determining range-to-go for the command detonation of a projectile warhead. Using dual laser detectors on the tail and on the nose of a spinning projectile to determine the range-to-go, time-to-go, or lateral offset from the projectile to the target. The method for controlling a projectile warhead uses a large area PIN detector and an ogive window. If the PIN detector is large enough to capture the second laser signal, the window is no longer an optical element, only a window thereby drastically reducing the cost of the system. In some cases the detector on the nose of the projectile comprises several PIN diodes placed around the projectile as a distributed aperture. Distributed apertures may also be created by placing the PIN diodes on the wing roots or body of the projectile.

15 Claims, 5 Drawing Sheets

PROJECTILE LENS-LESS ELECTRO OPTICAL DETECTOR FOR TIME-TO-GO FOR COMMAND DETONATION

FIELD OF THE DISCLOSURE

The present disclosure relates to munitions and more particularly to a system and method for accurately determining time-to-go for command detonation of a projectile warhead using a lens-less electro optical detector.

BACKGROUND OF THE DISCLOSURE

Precise command detonation maximizes the warhead effects against a target and is highly depended on the "range to go" or "time to go" prior or after impact. Depending on the target and warhead fragment pattern there is an optimum distance in front of the target for soft target (UAV, aircraft, combatants, etc.). For structures, a distance "after" the target, or a delayed detonation, may be useful when flight through a window is preferred, for example. In either case, knowing the time accurately has been difficult. Many simple rounds have used spin counters and by knowing the target range and the number of revolutions/meter from the projectile rifling, one can program the round to detonate after a particular spin count. However, these and other techniques rely on knowing the range to extreme accuracy prior to launch and are totally ineffective for moving targets. What is typically lacking is an architecture that measures the "time-to-go" to the actual target and thereby improves accuracy.

Wherefore it is an object of the present disclosure to overcome the above-mentioned shortcomings and drawbacks associated with conventional munitions.

SUMMARY OF THE DISCLOSURE

One aspect of the present disclosure is a method for controlling a projectile warhead, comprising: providing a projectile comprising a tail portion and a nose portion; detecting a first laser signal via a detector mounted on the tail portion of the projectile; determining a first time at which the first laser signal is detected via the detector mounted on the tail portion of the projectile; detecting a second laser signal via a detector mounted on the nose portion of the projectile, the second laser signal being the first laser signal that has reflected off a target; determining a second time at which the second laser signal is detected via the detector mounted on the nose portion of the projectile; comparing the first time to the second time to determine a time delay; determining a lateral offset between the projectile and the target using the time delay between detection by the first detector and detection by the second detector; and determining the time delay between detection by the first detector and detection by the second detector of the projectile to accurately control detonation based on the fragmentation pattern for the projectile.

One embodiment of the method for controlling a projectile warhead is wherein the detector on the tail of the projectile is an electro-optical PIN diode.

One embodiment of the method for controlling a projectile warhead is wherein the detector on the nose of the projectile is a large area PIN detector and a simple ogive window. In some cases, the large area PIN detector is large enough to capture the second laser signal such that the window is no longer an lens having optical power, only a window thereby drastically reducing the cost of the system.

Another embodiment of the method for controlling a projectile warhead is wherein the detector on the nose of the projectile comprises several PIN diodes placed around the projectile as a distributed aperture. In some cases, the second detector comprises several PIN diodes placed on a projectile body or wing roots instead of the nose of the projectile.

In yet another embodiment of the method for controlling a projectile warhead, a range finding clock is started when the first signal is detected ($T_0$) by the detector on the tail of the projectile and the range finding clock is stopped when the second signal is detected by the detector on the nose of the projectile ($T_2$), thereby creating a time differential that represents a round trip time between the projectile and the target which can be converted to a range-to-go.

In some cases, a range finding clock is started when the first signal is detected ($T_0$) by the detector on the tail of the projectile and the range finding clock is stopped when the second signal is detected by the detector on the nose of the projectile ($T_2$), thereby creating a time differential that represents a round trip time between the projectile and the target which can be used as a time-to-go, or limit trip switch.

In still yet another embodiment of the method for controlling a projectile warhead, wherein the time-to-go is time about 0.005 seconds, a signal is sent to the projectile to cause the projectile to detonate. In some cases, the time-to-go determination is dependent on the projectile speed and the detonation time-to-go is programed at the time of launch. In certain embodiments, the time-to-go value is negative.

Another aspect of the method for controlling a projectile warhead is when the first signal further comprises a first pulse repetition interval and the second signal further comprises a second pulse repetition interval. In some cases, the lateral offset between the projectile's trajectory and the target's actual position is determined by measuring a time expansion between the first pulse repetition interval and the second pulse repetition interval and convolving the projectile's velocity with the time-to-go thereby improving an accuracy of a detonation.

Yet another aspect of the present disclosure is a guided projectile, comprising; a tail sensor located on a tail portion of the guided projectile for detecting a laser signal; a front sensor located on a forward portion of the guided projectile and detecting a reflected laser signal from a target; a computer readable storage device having instructions, which when executed by a processor, cause the processor to execute: determining a first time at which the laser signal is detected by the tail sensor; determining a second time at which the reflected signal is detected by the front sensor; comparing the first time to the second time to determine a time delay; determining a lateral offset between the projectile and the target; and determining the time delay between detection by the tail detector and detection by the front detector to accurately control the detonation.

These aspects of the disclosure are not meant to be exclusive and other features, aspects, and advantages of the present disclosure will be readily apparent to those of ordinary skill in the art when read in conjunction with the following description, appended claims, and accompanying drawings.

BRIEF DESCRIPTION OF THE DRAWINGS

The foregoing and other objects, features, and advantages of the disclosure will be apparent from the following description of particular embodiments of the disclosure, as illustrated in the accompanying drawings in which like reference characters refer to the same parts throughout the different views. The drawings are not necessarily to scale, emphasis instead being placed upon illustrating the principles of the disclosure.

DETAILED DESCRIPTION OF THE DISCLOSURE

Figure 1A:
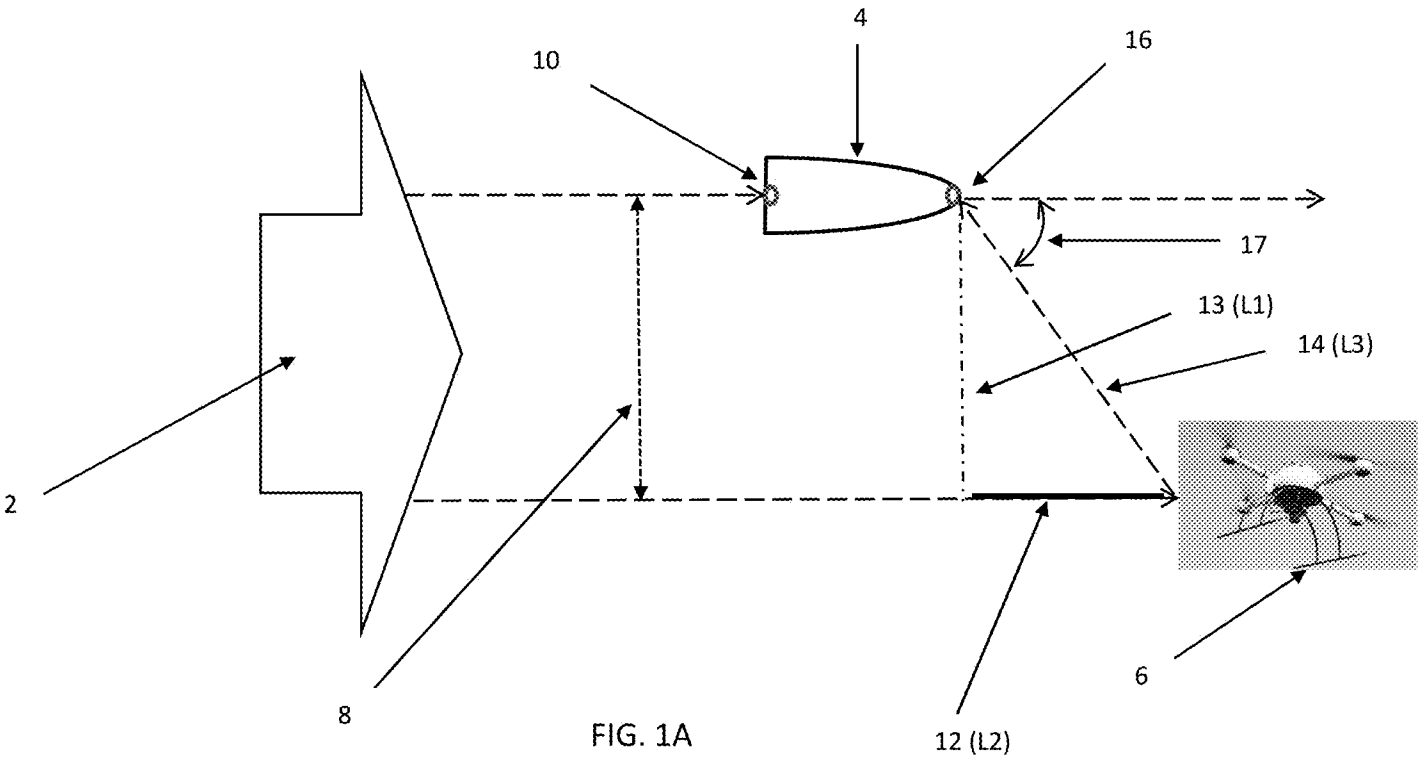
FIG. 1A shows one embodiment of the system of the present disclosure.

One embodiment of the present disclosure is a system for accurately determining the range-to-target distance for a munition. In one embodiment, the accuracy is within less than a meter. In some cases, the system utilizes a low energy, short pulse laser (e.g., fiber laser) or radio frequency pulse to paint a target. The short pulse can be 1 to 50 nanoseconds depending on the transmitter. In some cases, the system is low power since the path is one way from the illuminator to the projectile. In certain embodiments, low energy is about 100 μJoules per pulse.

In certain embodiments, munitions are laser guided. There, a target is illuminated, or "painted," by a laser target designator on the ground or on an aircraft. One disadvantage of laser guided munitions is in poor weather the system may not be useable because the target illumination cannot be seen, or if the target designator cannot get near the target. In certain embodiments, a laser designator sends a beam in a coded series of pulses so the munition will identify the proper signals, and that way multiple designators can operate in the same region.

In certain embodiments, the munitions are guided with radio control. In some cases, an aircraft transmits control signals to the munition to guide it to the target. In some cases, the RF or laser signal emanates from a plane or vehicle weapons fire control system. The fire control system guides the weapon to the target using the RF, electro-optical (EO), or a combination of the two modalities and illuminates the target during the terminal end game or region near the target.

In certain embodiments, the target may be large and fixed, but in other embodiments the target may be a small, moving target or something in between. In one embodiment, the target is an unmanned vehicle, such as a drone. In one embodiment, the target is vehicle, such as an air or land vehicle. In one embodiment, the target is building.

In certain embodiments of the system of the present disclosure, a spinning projectile, or munition, is guided to the target from a tracking station. In some cases, a tracking station may be on the ground, such as part of command and control. In some cases, the tracking station may be on a vehicle. In certain embodiments, the munition is guided by a fire control system on the launch platform.

In some cases, the munition is spinning at 0.5-2 k revolutions/second. In some cases, the munition is a fly-by projectile that has a directional blast pattern that necessitates accurate detonation in order to hit the target with a maximum number of fragments while mitigating unintended hits or misses. In some embodiments, the blast pattern may be about 1-3 m wide.

In certain embodiments, the fiber laser, or the like, is used to emit radiation to paint the target and/or to track the munition. In some cases, the emitted radiation is used to provide an azimuth (Az) and an elevation (El) bearing for the projectile relative to the target. In some cases, the radiation will hit the back of the projectile and reflect back to the tracking station, or the like. In some cases, the tracking station reports only the Az and El position for the projectile, thus simplifying the electro-optical (EO) system used in the present command detonation system.

One aspect of the present disclosure is a system comprising a radio frequency (RF) or laser short energy pulse (10 to 100 ns) that illuminates a projectile's rear sensor and one or more targets. The energy of the short energy pulse is reflected off the target and is received by a second sensor on the nose of the projectile. The first sensor detects the pulse energy as it passes by the projectile, generating a $T_{zero}$ (i.e., the start of a range finding clock). The clock is stopped when the target's reflected energy is detected by the second sensor at $T_{reflected}$. The time differential represents the round trip time between the projectile and the target which can be converted to a range.

In ballistics or aerodynamics, an ogive is a pointed, curved surface mainly used to form the streamlined nose of a bullet or other projectile, reducing air resistance or the drag of air. On projectiles, EO lenses are problematic, especially in the front ogive. Certain embodiments of the present disclosure can be applied to any optical transmissive ogive with no lens/surface requirements. Most lens designs accompany an imaging system, but since this approach is measuring only time of arrival of the pulse of the target the lens in an ogive shape can be replaced by a window to allow light to radiate in to a large area detector comprising PIN diodes, directly. This saves cost, because there is no lens to design, and no cost for high performance optics, just a window and a detector.

In one embodiment of the system of the present disclosure, the system uses the measured RF or laser energy detection from sensor 1 and 2 in a simple limit trip switch approach. When the time-to-go is time <0.010 seconds, or the like, the projectile will detonate. In certain embodiments, the time is dependent on the projectile speed, warhead ideal detonation distance, and other factors. The "time-to-go" could be a time variable programed at launch and/or could be negative (e.g., when flying through a window).

Another embodiment of the present disclosure determines the lateral offset between the projectile's trajectory and the target's actual position (i.e., a lateral miss distance). In this embodiment, the projectile's rear sensor(s) can determine the projectile's velocity by measuring the time increase between each pulse interval. The time base of each illumination pulse or the pulse repetition interval (PRI) serves as means to measure the time expansion between pulse intervals. If the projectile was not moving, the PRI would match the expected PRI. For a 40 Hz system the PRI is 25 milliseconds. A projectile at MACH 3 would travel 25 meters. The 25 meters→81 feet→81 nanosecond (speed of light) increases the PRI time base which can be measured and tracked. By convolving the velocity of the projectile with the "time-to-go," one can determine the lateral offset, thereby improving/optimizing the accuracy of the detonation.

In one embodiment of the system of the present disclosure, the system could utilize a large area PIN detector and a simple ogive window for aerodynamics. The large area PIN eliminates the need for an optical lens to focus the return target energy onto the detector, reducing optical complexity that focuses the signal while maintaining an ogive for the aerodynamics of the projectile/missile. In some cases, the large area PIN detector is large enough to capture all the energy and the window is no longer a lens having optical power, only a window thereby drastically reducing cost of the system.

Another embodiment of the present disclosure, not illustrated, several PIN diodes can be placed around the projectile/missile as a distributed aperture. In some cases the nose of the projectile/missile is not accessible to sensors and they can be placed on the body or wing roots.

High kill percentage detonations need to ensure the target is within a kill zone by measuring the actual offset angle to the projectile relative to the threat. This approach measures that angle. One embodiment of the present disclosure is placing a pin diode on the rear of the projectile and an array on the projectile's forward surface, or nose. By painting the target with a low power, short pulse laser (e.g., a fiber laser) the rear facing detector generates the time zero ($T_0$) and the laser return off the projectile generates the range-to-go and angle between the projectile's centerline and the threat at a second time point ($T_2$). range and speed of the projectile, the optimum command detonation can be realized.

In some cases, the rear facing detector/antenna generates a time zero ($T_0$) as well as Az and El information for the projectile. In certain embodiments, a laser return off the projectile, which is detected by the detector on the face of the projectile, generates the range-to-go to the target. This method eliminates the need to determine the range at the tracking station, thus reducing the cost of the scanner and the peak power of the laser or RADAR necessary to paint the target.

In some cases, the system also eliminates the complex latency of the tracking system since the projectile acts as its own reference. By using the same laser or radio output, and mounting a pair of receivers on the munition, the losses are reduced from $R^4$ and approach $R^2$ losses. In a traditional system where the fire control system uses RADAR or LIDAR to track the projectile and the target, the losses are in terms or range$^4$ or $R^4$. The energy goes out to both the target and the projectile generating $R^2$ losses in the outgoing and the return energy; thereby producing $R^4$ losses. By using one path ($R^2$) the power need can be reduced from megawatts to kilowatts or the power needed can be reduced by the square root of the power needed for a LIDAR. This assumes first order and neglects environmental losses.

Since unmanned aircraft are very small, LIDAR and RADAR are ineffective at generating range-to-go for a projectile to the target due to the small signatures of the targets. By tracking them with EO sensors at the fire control system, the azimuth (Az) and elevation (El) of the target can be determined. There, range remains difficult given the weak return signal. The projectile can still be launched and guided to the target using a version of line of sight (LOS) command guidance. As the projectile approaches the target, the weak signal goes from $R^4$ at the beginning of the flight to $R^2$ prior to target contact. Even a weak signal is detected with the system of the present disclosure since the receiver in now on the projectile.

Referring to FIG. 1A, one embodiment of the disclosure is shown. More specifically, a laser pulse and/or an RF pulse 2 is propagated in the direction of a target 6 and a munition 4. The laser pulse and/or RF pulse is used to determine the Az and El of the projectile by detecting reflected signals with at least two sensors located on the projectile. The trajectory error 8 associated with the Az and El data is determined by a Fire Control EO/RF subsystem. In some cases, the Fire Control subsystem is located on the projectile's launch platform. In certain embodiments, a detector mounted on the rear of the projectile 10 detects the laser pulse and/or RF pulse and establishes a time zero ($T_0$). In some cases, the laser pulse is reflected off the target 14 and is detected by a nose-mounted detector 16 on the munition/projectile at a second time point ($T_2$). In some cases, the forward-facing detector is an array PIN diode, a large area PIN diode, or the like.

Still referring to FIG. 1A, determining the time delay between the detection of the radiation signal at the back 10 of the munition 4 and the detection of the reflected radiation signal off the target by the detector mounted about the projectile front 16, allows a range-to-go to be calculated. This approach also allows the projectile 4 to know its lateral offset from the target. In some embodiments, the lateral offset is determined by the Fire Control system and the time-to-go is determined from the laser pulse. By using the time delay calculated from the differential path 12, an accurate detonation time can be set. In other words, a first signal is detected by the detector mounted on the rear 10 of projectile 4 and a second reflected signal is detected by the front detector located on the front 16 of the projectile as the signal is reflected back from the target. This process is repeated as the projectile 4 is in flight and the calculation of range-to-go is in real-time.

Figure 1B:
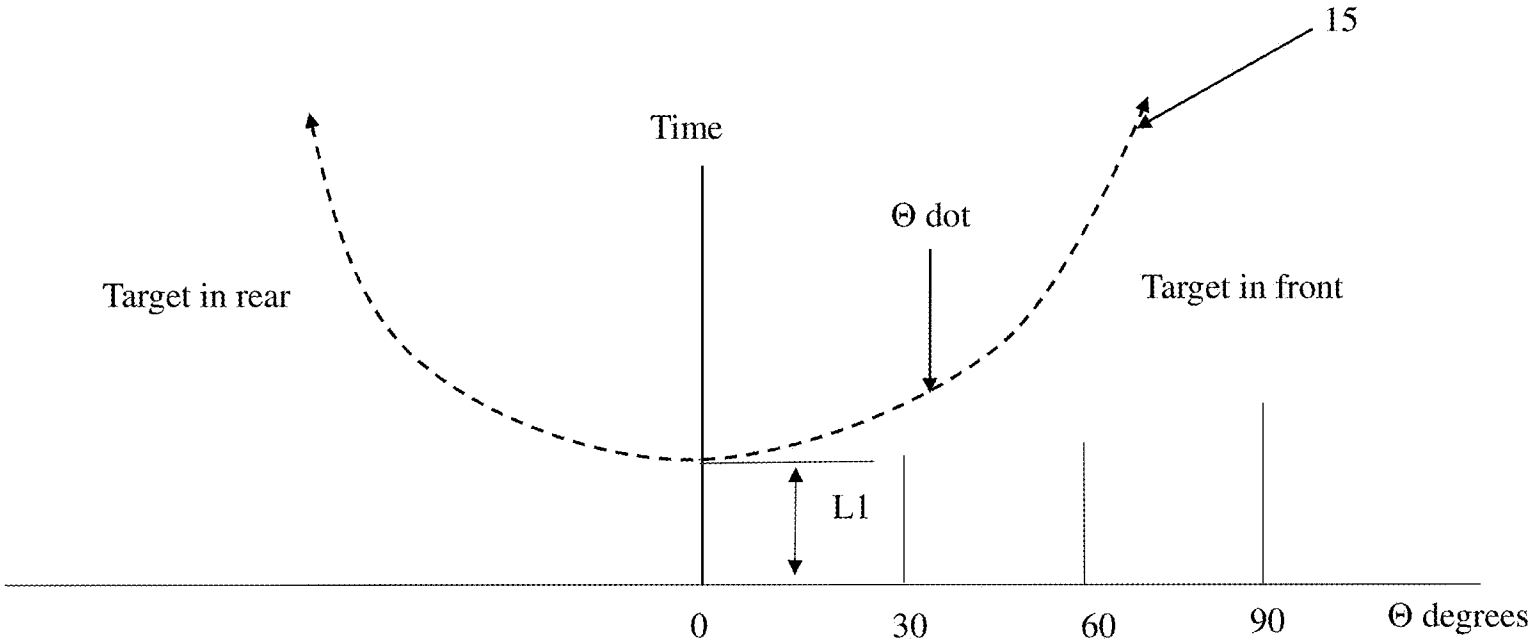
FIG. 1B shows calculations for range-to-go, lateral offset, and the like according to the principles of the present disclosure.

Referring to FIG. 1B, the calculations for range-to-go, lateral offset, and the like according to the principles of the present disclosure are shown. More specifically, a plot of theta, θ, against time is shown. The lateral offset L1 is shown. There is it possible to see that as the projectile (e.g. munition) flies over the target, the distance and thus the time from the munition 15 is asymptotic such that the curve goes from 0° when the projectile is directly over the target and approaches 90° when the projectile is about 20 to 50 meters away from the target, ignoring the length of the munition. At that point, as shown in FIG. 1A, it would be near linear (L2=L3) and L1 would come into play and be a minor contributor. Where sin Θ=L2/L3, Time=L2+L3 (ignoring the weapon length); L3=time/(sin Θ+1) and L2=sin Θ*L3.

In certain embodiments, the front and/or rear detectors are EO PIN diodes. In some cases an array PIN diode, a large area PIN diode. EO systems using laser or narrow beam illuminators can direct the energy at longer distances to a specific target feature; a wall on a building, a door, a window, etc. The spatial control of some weapon systems may gravitate to an EO system for higher precision.

Figure 2:
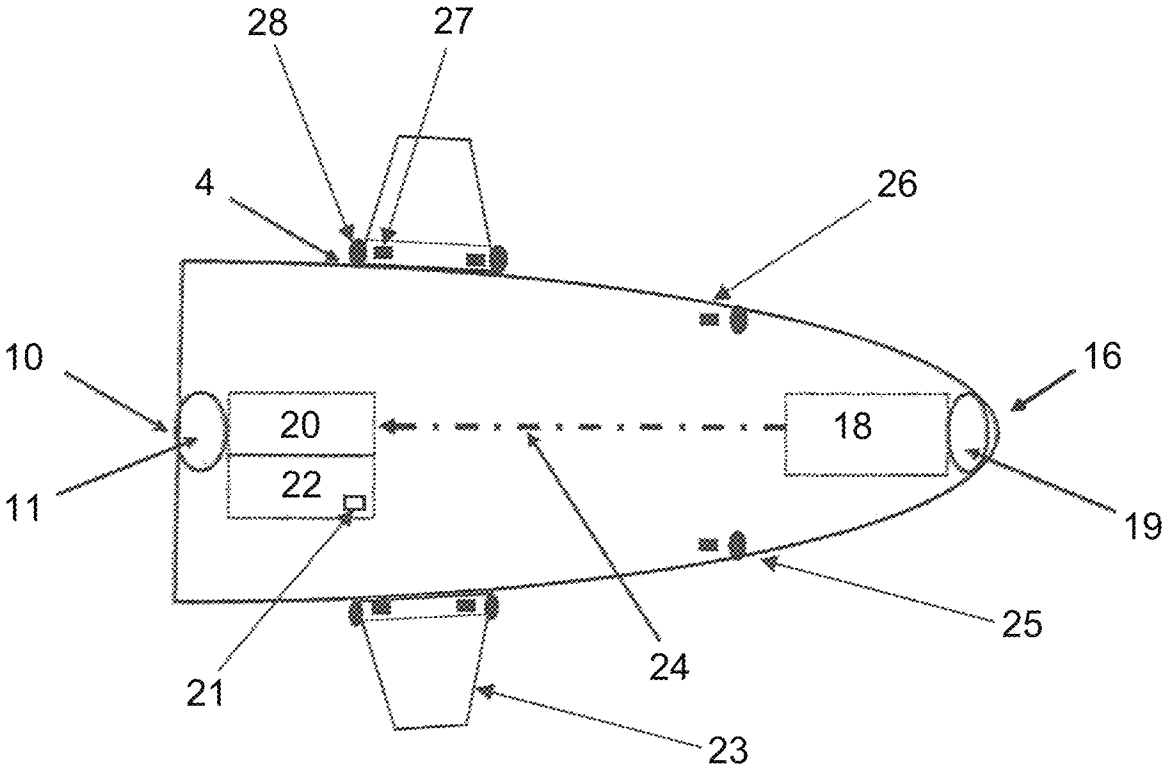
FIG. 2 illustrates two sensors with detector electronics and an associated processor on a munition according to the principles of the present disclosure.

Referring to FIG. 2, the construct of at least two sensors located on the munition according to the principles of the present disclosure is shown. The munition could be a guided projectile from a 0.5 caliber sniper round to a 155 mm artillery shell. The guidance package could be spinning with respect to the ordnance or could be roll stabilized using a bearing between the ordnance and the guidance package. In some cases, the time-to-go measurement can be accomplished with the elements shown in FIG. 2. More specifically, a front detector 19, a large area PIN diode. In some cases, the rear detector 11 may be one or more detectors, where the detector is an RF antenna, an EO with one or more lenses, or the like. In some cases, the detectors comprise several PIN diodes (27,26) and optics (28, 25) placed around the projectile body (25, 26) or at the wing roots (27,28). The wing roots being the base of the wings 23. In certain embodiments, the front detector electronics 18 is in communication 24 with the rear detector electronics 20 and a processor 22. In some cases, the communication link may be a cable, a magnetic inductance link, an RF link, an optical link, or the like. The range finding clock 21 is a clock contained in the processor 22 for measuring the time between the pulses received at rear and front detectors.

In certain embodiments, the method calculating the optimum is comparing the projectile/missile speed relative to the time-to-go. If the target is directly in front of the projectile, then the time-to-go should decrease at the same rate as the projectile—everything in a straight line (i.e., segment 12 in FIG. 1 is the range-to-go). If the target has a lateral offset, the hypotenuse 14 is longer due to the lateral offset; thereby the closing velocity no longer matches the speed of the projectile. In some cases, that offset can be estimated using a Kaman filter to determine the optimum time-to-go.

Figures 3A, 3B:
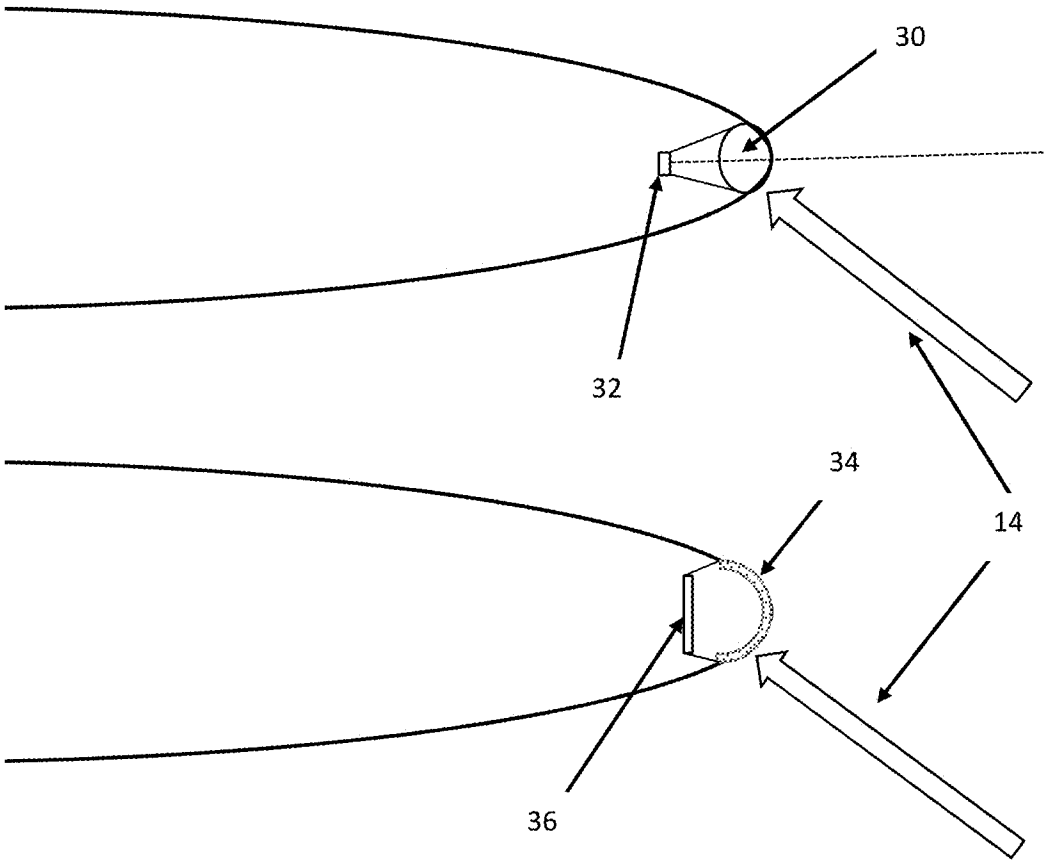
FIG. 3A shows one embodiment of the system of the present disclosure using traditional optics.
FIG. 3B shows one embodiment of the system of the present disclosure using a large area detector and a window at the ogive of a projectile.

Referring to FIG. 3A, one embodiment of the system of the present disclosure using traditional optics is shown. More specifically, the more conventional approach to a detector in the nose of a projectile tries to blend aerodynamic requirements of the projectile with optical requirements of an electro optical system by using a lens. Here, a lens 30 is used to focus incoming radiation 14 that was reflected of a target onto a small EO detector 32. The angle of the incoming radiation creates mismatch with the lens's ability to focus the light onto the detector 32.

Referring to FIG. 3B, one embodiment of the system of the present disclosure using a large area detector and a window at the ogive of a projectile is shown. More specifically, a large area PIN diode or the like 36 is used to detect the radiation 14 entering through a window 34 on the ogive of the projectile. By removing the optical requirements from the surface, the window needs only to be transmissive to the optical energy. Depending on the speed of the projectile/missile, the window could be a simple injection molded plastic in sub-Mach munitions or molded glass shapes for higher Mach numbers with elevated heat considerations. In some cases, the elimination of the optical lens requirements yields a low cost window (e.g. $5).

Figure 4:
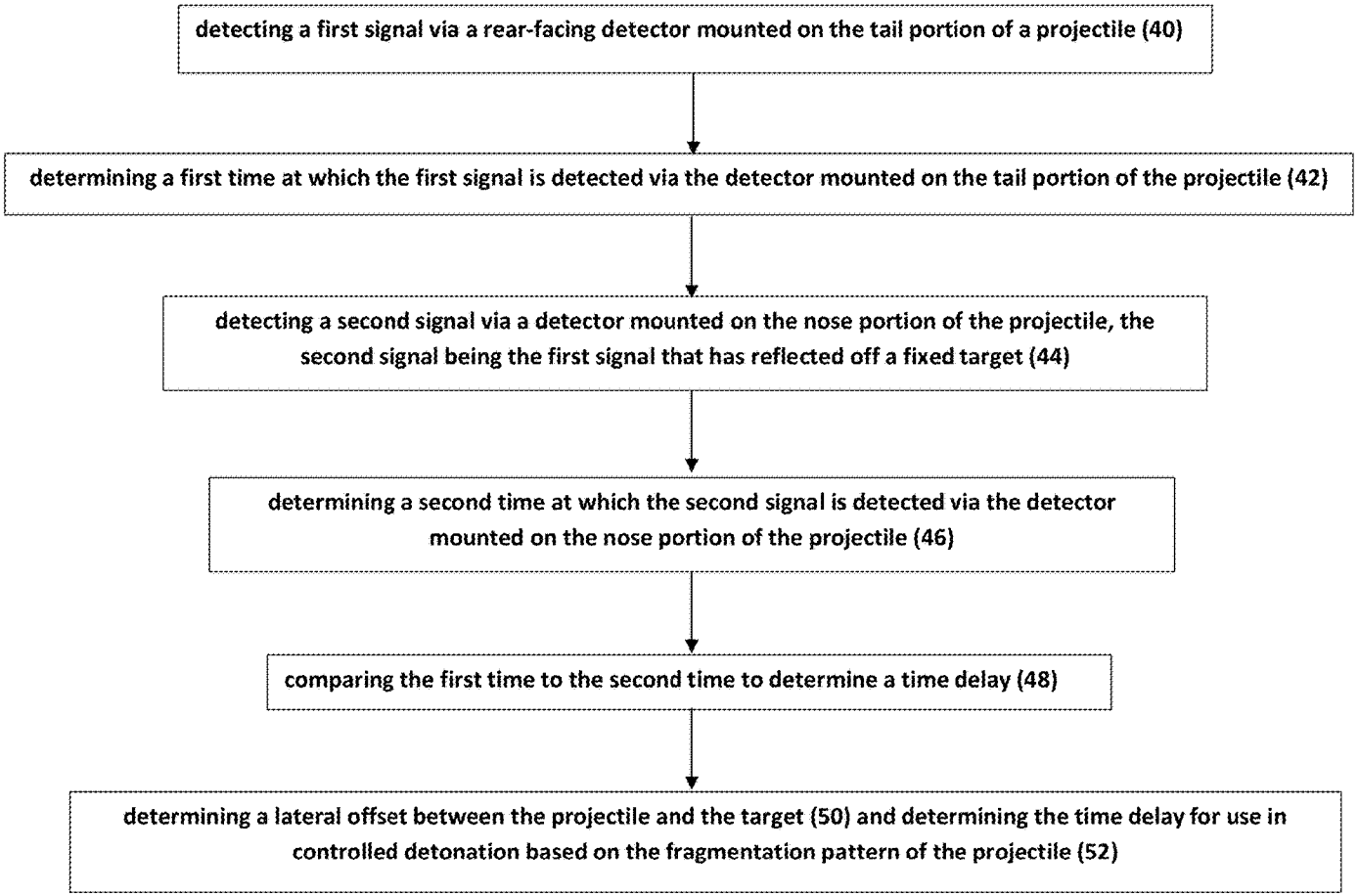
FIG. 4 shows a flowchart of an embodiment of a method according to the principles of the present disclosure.

Referring to FIG. 4, a flowchart of one embodiment of a method according to the principles of the present disclosure is shown. More specifically, the system detects a first laser or radio frequency signal via a rear-facing detector mounted on the tail portion of a projectile (40) and determines a first time at which the first laser or radio frequency signal is detected via the detector mounted on the tail portion of the projectile (42). The system detects a second laser or radio frequency signal via a detector mounted on the nose portion of the projectile, the second laser or radio frequency signal being the first laser or radio frequency signal that has reflected off a fixed target (44) and determines a second time at which the second laser or radio frequency signal is detected via the detector mounted on the nose portion of the projectile (46). The system compares the first time and the second time to determine a time delay (48). Next, by determining a lateral offset between the projectile and the target (50) and determining the time delay the system can be used in controlled detonation based on the fragmentation pattern of the projectile (52).

While various embodiments of the present invention have been described in detail, it is apparent that various modifications and alterations of those embodiments will occur to and be readily apparent to those skilled in the art. However, it is to be expressly understood that such modifications and alterations are within the scope and spirit of the present invention, as set forth in the appended claims. Further, the invention(s) described herein is capable of other embodiments and of being practiced or of being carried out in various other related ways. In addition, it is to be understood that the phraseology and terminology used herein is for the purpose of description and should not be regarded as limiting. The use of "including," "comprising," or "having," and variations thereof herein, is meant to encompass the items listed thereafter and equivalents thereof as well as additional items while only the terms "consisting of" and "consisting only of" are to be construed in a limitative sense.

The foregoing description of the embodiments of the present disclosure has been presented for the purposes of illustration and description. It is not intended to be exhaustive or to limit the present disclosure to the precise form disclosed. Many modifications and variations are possible in light of this disclosure. It is intended that the scope of the present disclosure be limited not by this detailed description, but rather by the claims appended hereto.

A number of implementations have been described. Nevertheless, it will be understood that various modifications may be made without departing from the scope of the disclosure. Although operations are depicted in the drawings in a particular order, this should not be understood as requiring that such operations be performed in the particular order shown or in sequential order, or that all illustrated operations be performed, to achieve desirable results.

While the principles of the disclosure have been described herein, it is to be understood by those skilled in the art that this description is made only by way of example and not as a limitation as to the scope of the disclosure. Other embodiments are contemplated within the scope of the present disclosure in addition to the exemplary embodiments shown and described herein. Modifications and substitutions by one of ordinary skill in the art are considered to be within the scope of the present disclosure.

What is claimed:

1. A method for controlling a projectile detonation, comprising:

providing a projectile comprising a tail portion and a front portion;

detecting a first laser signal via a tail detector mounted on the tail portion of the projectile;

determining a first time at which the first laser signal is detected via the tail detector mounted on the tail portion of the projectile;

detecting a reflected laser signal via a front detector mounted on the front portion of the projectile, the reflected laser signal being the first laser signal that has reflected off a target;

determining a second time at which the reflected laser signal is detected via the front detector mounted on the front portion of the projectile;

comparing the first time to the second time to determine a time delay;

determining a lateral offset between the projectile and the target; and determining the time delay between detection by the tail detector and detection by the front detector of the projectile to accurately control a detonation of the projectile based on a fragmentation pattern for the projectile.

2. The method for controlling a projectile detonation according to claim 1, wherein the tail detector is an electro-optical PIN diode.

3. The method for controlling a projectile detonation according to claim 1, wherein the front detector is a large area PIN detector and an ogive window.

4. The method for controlling a projectile detonation according to claim 3, wherein the large area PIN detector is configured to capture the reflected laser signal.

5. The method for controlling a projectile detonation according to claim 1, wherein the front detector comprises several PIN diodes placed around the projectile as a distributed aperture.

6. The method for controlling a projectile detonation according to claim 1, wherein the front detector comprises several PIN diodes placed on a projectile body or wing roots of the projectile.

7. The method for controlling a projectile detonation according to claim 1, wherein a range finding dock is started when the first signal is detected (T0) by the tail detector and the range finding dock is stopped when the reflected signal is detected by the front detector (T2), thereby creating a time differential that represents a round trip time between the projectile and the target which can be converted to a range-to-go value.

8. The method for controlling a projectile detonation according to claim 1, wherein a range finding dock is started when the first signal is detected (T0) by the tail detector and the range finding clock is stopped when the reflected signal is detected by the front detector (T2), thereby creating a time differential that represents a round trip time between the projectile and the target which can be used as a time-to-go value, or limit trip switch.

9. The method for controlling a projectile detonation according to claim 8, wherein when the time-to-go value is about 0.005 seconds, sending a signal to the projectile to cause the projectile to detonate.

10. The method for controlling a projectile detonation according to claim 8, wherein the time-to-go determination is dependent on a projectile speed of the projectile and the time-to-go is programmed at a time of a launch of the projectile.

11. The method for controlling a projectile detonation according to claim 8, wherein the time-to-go value is negative, such as when flying through a window.

12. The method for controlling a projectile detonation according to claim 1, wherein the first laser signal further comprises a first pulse repetition interval and the reflected signal further comprises a second pulse repetition interval.

13. The method for controlling a projectile detonation according to claim 12, wherein the lateral offset between a projectile's trajectory and a target's actual position is determined by measuring a time expansion between the first pulse repetition interval and the second pulse repetition interval and convolving the projectile's velocity with the time-to-go thereby improving an accuracy of the detonation.

14. The method for controlling a projectile detonation according to claim 13, wherein determining the lateral offset uses the time delay between detection by the tail detector and detection by the front detector.

15. A guided projectile, comprising;

a tail sensor located on a tail portion of a guided projectile for detecting a laser signal;

a front sensor located on a forward portion of the guided projectile for detecting a reflected laser signal from a target;

a computer readable storage device having instructions, which when executed by a processor, cause the processor to execute:

determining a first time at which the laser signal is detected by the tail sensor;

determining a second time at which the reflected signal is detected by the front sensor;

comparing the first time to the second time to determine a time delay;

determining a lateral offset between the projectile and the target; and determining the time delay between detection by the tail sensor and detection by the front sensor to accurately control a detonation of the guided projectile.

* * * * *